US005749117A

United States Patent [19]

Forsline

[11] Patent Number: 5,749,117

[45] Date of Patent: May 12, 1998

[54] PAINT APPLICATOR HAVING AN IMPROVED WORKING TIP

[76] Inventor: Ladd B. Forsline, 201 S. Kemp St., Lyons, Pa. 19536

[21] Appl. No.: 717,090

[22] Filed: Sep. 20, 1996

[51] Int. Cl.[6] ..... B05C 17/00

[52] U.S. Cl. ..... 15/245.1; 15/188; 15/425; 132/320; 401/199

[58] Field of Search ..... 15/188, 245.1, 15/425, 245; 132/218, 320; 118/410; 401/199

[56] References Cited

U.S. PATENT DOCUMENTS

| | | | |
|---|---|---|---|
| 589,209 | 8/1897 | Gould | 15/188 |
| 2,016,597 | 10/1935 | Drake | 15/188 |
| 2,099,030 | 11/1937 | Morrison . | |
| 2,147,310 | 2/1939 | Morrison . | |
| 2,149,950 | 3/1939 | Axline | 15/188 |
| 2,341,227 | 2/1944 | Mieth . | |
| 2,591,301 | 4/1952 | Schacht | 15/245 |
| 2,861,371 | 11/1958 | Leshik . | |
| 3,609,051 | 9/1971 | Brown . | |
| 3,897,602 | 8/1975 | Brennenstuhl . | |
| 4,083,078 | 4/1978 | Shimizu . | |
| 4,343,265 | 8/1982 | Belschner | 15/188 |
| 4,521,456 | 6/1985 | Hanson . | |
| 5,060,337 | 10/1991 | Van Niekerk | 15/188 |
| 5,072,479 | 12/1991 | Van Niekerk | 15/188 |
| 5,096,322 | 3/1992 | Shiga et al. . | |
| 5,320,442 | 6/1994 | Yanagisawa et al. . | |
| 5,328,011 | 7/1994 | Gueret . | |
| 5,351,357 | 10/1994 | Liberman . | |
| 5,491,869 | 2/1996 | Sullivan | 15/245 |
| 5,542,144 | 8/1996 | Forsline . | |

FOREIGN PATENT DOCUMENTS

| | | |
|---|---|---|
| 25 47 000 | 4/1976 | Germany . |
| 251734 | 5/1926 | United Kingdom . |

OTHER PUBLICATIONS

Sales catalog from Kemper Tools, the manufacturer of the "Wipe Out Tool", dated Sep. 1989.

Sax Arts and Crafts sales catalog, a distributor of the "Wipe Out Tool", dated winter of 1994.

*Primary Examiner*—Randall E. Chin

*Attorney, Agent, or Firm*—Patterson & Keough, P.A.

[57] ABSTRACT

A device for application and manipulation of paint on a substrate includes a handle having a distal end and a proximal end, and a working tip attached to the distal end of the handle. The working tip is a flexible, non-porous extruded material having a distal working edge which is formed by an extrusion process, with the working edge being parallel to a longitudinal orientation of the extrusion process. In one embodiment, one of the working tip and the handle includes a rib along an end which interfaces the other and the other of the working tip and the handle includes a corresponding slot in an end which interfaces the one for mating with the rib. Preferably, the working tip is made of silicone.

16 Claims, 3 Drawing Sheets

PAINT APPLICATOR HAVING AN IMPROVED WORKING TIP

FIELD OF THE INVENTION

The present invention relates to the field of devices for the application and manipulation of paint or paint-like substances upon a substrate. In particular, the present invention relates to applicators and manipulators having a flexible, impermeable, generally flat, extruded working tip.

BACKGROUND OF THE INVENTION

Since prehistoric times, people have applied and manipulated paint on substrates. Very early painters might have used their bare hands and fingers, as do children and even artists today, but the use of tools for painting became common very early. Some of the earliest of such tools were likely mere sticks. However, bristled brushes have been known and in use for much of modern history. Traditionally, bristled brushes were formed from natural materials such as the hair of animals attached to a wooden handle. With the development of modern synthetic plastics, artificial bristles have become available also. Bristle tipped brushes are characterized by a tendency to draw or wick a supply of paint into the intersticial spaces between the bristles and subsequently release a portion of such paint when the bristles are applied to a substrate. This may be viewed as somewhat wasteful of paint and moreover results in a significant cleanup problem. Cleaning of a bristle brush in order to apply or manipulate a different paint color can slow down the painter and truly interrupt and impede the creative process. Further, failure to promptly and appropriately clean a brush after use often times renders the brush useless for any future use because the intersticial paint irreversibly dries within the body of the brush. The cost of good natural bristle brushes is generally rising and the cost of synthetic bristle substitutes, while often less costly than the natural variety, also is generally rising.

As an alternative to bristled brushes, painters have also used stiff, spring-like metal spatulas for application and manipulation of more viscous paints. U.S. Pat. No. 2,861,371 to Leshik discloses some exemplary steel spatulas. U.S. Pat. Nos. 2,099,030 and 2,147,310 to Morrison disclose some exemplary rubber spatulas for liquid and dry color painting, respectively. While spatula-like tools provide some advantages over traditional bristle brushes in terms of longevity and cleaning, they have generally been regarded as a separate type of paint applicator with their own unique manner of marks. The way in which spatula-type applicators are constructed contributes to this difference, especially for rubber spatulas. Presently, all of the ends for rubber spatulas are cast or molded and most require a cavity in the proximal end into which a handle is inserted or the end and the handle are molded together. The use of a molded or cast end increases production costs and the insertion of the handle into the end to secure the two together results in an applicator which has an entirely different feel than a conventional paint brush.

U.S. Pat. No. 3,609,051 to Braun discloses a rotatable brush having a rotatable tip made of a porous resilient material. Using the rolling application techniques of longer, conventional paint rollers for coating walls and the like, this tool provides another alternative to a conventional bristle brush. Again, because of the different manner in which this tool applies paint to a surface, painters generally would not regard this tool as a replacement for the more versatile bristle brushes. In addition, due to the porous nature of the rolling tip, this tool also has problems with cleaning and longevity of the tool. A similar problem exists for conventional "sponge" brushes where a porous sponge material is attached to the end of a dowel to provide an inexpensive, often single-use, paint applicator. These kinds of porous tip applicators are also not well suited for oil-based paints as the solvents in oil-based paints tend to destroy the porous tip.

In U.S. Pat. No. 5,542,144 a new alternative to conventional bristle brushes is disclosed in the form of a Silicone Paint Brush Artist's Tool. In this tool, a non-porous, impermeable silicone painting tip is attached to a conventional artist's paint brush handle by attaching a ferrule to the handle and expansively locking the silicone tip within the ferrule. The painting tip of this invention is made of a softer, resilient silicone of a durometer between 20 and 70 shore so as to allow the painting tip to effectively serve as a paint applicator. A paint removal tool with a rubber tip known as the Wipe Out Tool utilizes a ethylene propylene or chloroprene rubber tip harder than 70 shore for the removal of clay and paint. In the case of each of these tools, however, the tips must be individually cast into the desired shape, a process which increases the cost of producing the tool. In addition, each of the tools is designed primarily for artistic purposes, rather than for general application of paint to surfaces. As a result, the tips are three-dimensional in nature and relatively small to allow for fine detail work with a high degree of control over the movement of the tip.

Although alternatives to conventional bristle brushes have been developed, these tools typically have a more limited range of marks and manners of applying paint to a surface that are not as versatile as conventional bristle brushes. Consequently, these tools have generally not been regarded by painters as replacements for a conventional bristle brush, but instead these tools have been seen as alternative types of paint applicators. Accordingly, it would be desirable to provide a paint applicator that has improved longevity and cleaning characteristics and can be utilizes in the application of all types of paints to surfaces, but otherwise could be accepted as an effective replacement for traditional bristle brushes.

SUMMARY OF THE INVENTION

The present invention is device for application and manipulation of paint on a substrate which includes a handle having a distal end and a proximal end, and a working tip attached to the distal end of the handle. The working tip is a flexible, non-porous extruded material having a distal working edge which is formed by an extrusion process, with the working edge being parallel to a longitudinal orientation of the extrusion process. In one embodiment, one of the working tip and the handle includes a rib along an end which interfaces the other and the other of the working tip and the handle includes a corresponding slot in an end which interfaces the one for mating with the rib. Preferably, the working tip is made of silicone.

One advantage of the device of the present invention is the ability to provide a variety of features for the application or manipulation of paint on a substrate. Significantly, the working tip is preferably made of silicone and the selection of silicone as the tip material offers a range of harder or softer tips, which provide distinctive effects on the paint. The durometer readings of useful tip materials range from about 20 Shore A durometer hardness to about 70 Shore A Hardness units. Tips of various hardness can be made even more useful to the painter by including a color indicia within the material prior to forming the tips. This aspect of the invention allows an artist rapid visual identification and selection of an appropriately hard or soft tip. In another embodiment, the working tip may have either a sharp peripheral edge for cutting and removal of wet paint and a soft peripheral edge for spreading, or preferably, both. It has been found that if the peripheral edge of the working top has a radius between 0.005" and 0.0175" a sharp edge is created that is useful as a cutting or removal edge, whereas if the radius is greater than 0.0175" a smooth edge is created that is useful for spreading. Ideally, both edges are provided on different sides of the distal working edge of the working tip. In an alternative embodiment, a series of longitudinal slits are created in the working end of the tip to further enhance the wicking or carrying ability of the painting tip.

The advantages and uses of devices of the present invention are numerous. Principally, the design and operation of the present invention more closely replicates the characteristic functions of a traditional bristle brush than existing alternative tools, and, as a result, the devices can be used as effective replacements for, rather than alternatives to, traditional bristle brushes. The devices can be used to apply paint to a substrate in a manner similar to a bristle brush in that similar hand movements are used to manipulate the tool and that the tool can "carry" paint from one location on a surface to another merely by lifting the tool off the surface. The feel of the device more closely replicates a conventional paint brush, as opposed to a spatula-type applicator, because the tip and handle are preferably connected within a ferrule so as to allow the tip to bend and flex in a manner very similar to the way the bristles of a paint brush bend and flex in operation. In addition to applying paint, the present invention offers additional advantages over bristle brushes in terms of the ability to manipulate paint once applied to the surface, including, spreading paint upon a substrate, blending a multiplicity of undried paints on a substrate or on a palette, moving paint across a substrate surface (much like a "squeegee") and even removing paint from a substrate before the paint dries and bonds to the substrate. In this sense, the present invention more closely simulates the functional characteristics of the human fingers when used to manipulate paint once it has been applied to a surface. Because paint remains on the tip surface, less paint is wasted than in bristle brushes. Because bristles are absent, stray bristle marks (i.e. marks from bristles inadvertently displaced and disoriented from the main group of bristles) are not encountered.

By applying more or less pressure during paint application, a painter can acquire surprising control over the amount or depth of paint deposited upon the substrate using a device of the present invention. Surprisingly, the "touch" for adequate control of application pressure is developed quickly by a user. The appearance or "mark" left in the deposited paint can be manipulated to be similar to or different than that which is generated by a bristle brush. By employing a sharp, yet soft and flexible edged device of this invention, undried paint can be scraped off from even very soft substrates, allowing errors in the application of paint to be corrected. If texture is desired in the marks to be created, it is possible, for example, to apply texture bumps, grooves, or the like to the paint contacting surface of the device.

Another advantage of the present invention is that, while bristle brushes tend to be quite specifically designed for the particular paint types, the devices of the present invention are useful with a wide range of paints. This, in turn, reduces the number of devices an artist needs to paint effectively, thereby saving both time and expense.

Yet another advantage is the ease of cleanup. In particular, the tip surfaces of the present invention, when formed of silicone, are easily cleaned while the paint is still wet. Often, only a simple wiping clean of the tip surface is required. If, however, the paint dries, the flexibility of the tip, in combination with the impervious surface, tends to allow dried paint to be easily cracked and peeled off of the tip. Under similar circumstances, a bristle brush would typically be unsalvageable. The ease of cleanup has significant advantages, particularly in the case of oil-based paints where the present invention can reduce or even eliminate the use of environmentally harmful cleaning solvents.

BRIEF DESCRIPTIONS OF THE DRAWINGS

DETAILED DESCRIPTION OF THE PREFERRED EMBODIMENTS

Comprehension of the present invention can be gained through reference to the drawings in conjunction with a through review of the following explanation. In order to facilitate a full appreciation of the invention, an overview of the preferred embodiment is initially provided. The overview is followed by more detailed explanation and some significant alternative embodiments. By "paint" herein is meant not only oil based paint, but also acrylic paint, latex paint, polyurethane finishes, stains, watercolor paint, ink, charcoal and graphite and other such liquid, solid, emulsions, suspensions, and thixotropic substances applied to a range of substrates for artistic, decorative or protective purposes.

In a first embodiment, the present invention is a device for applying and manipulating paint on a substrate. For purposes of facilitating comprehension, it may be initially thought of a substitute for the traditional well known bristle brush. However, it is easier to clean and allows novel results in use.

Figure 1:
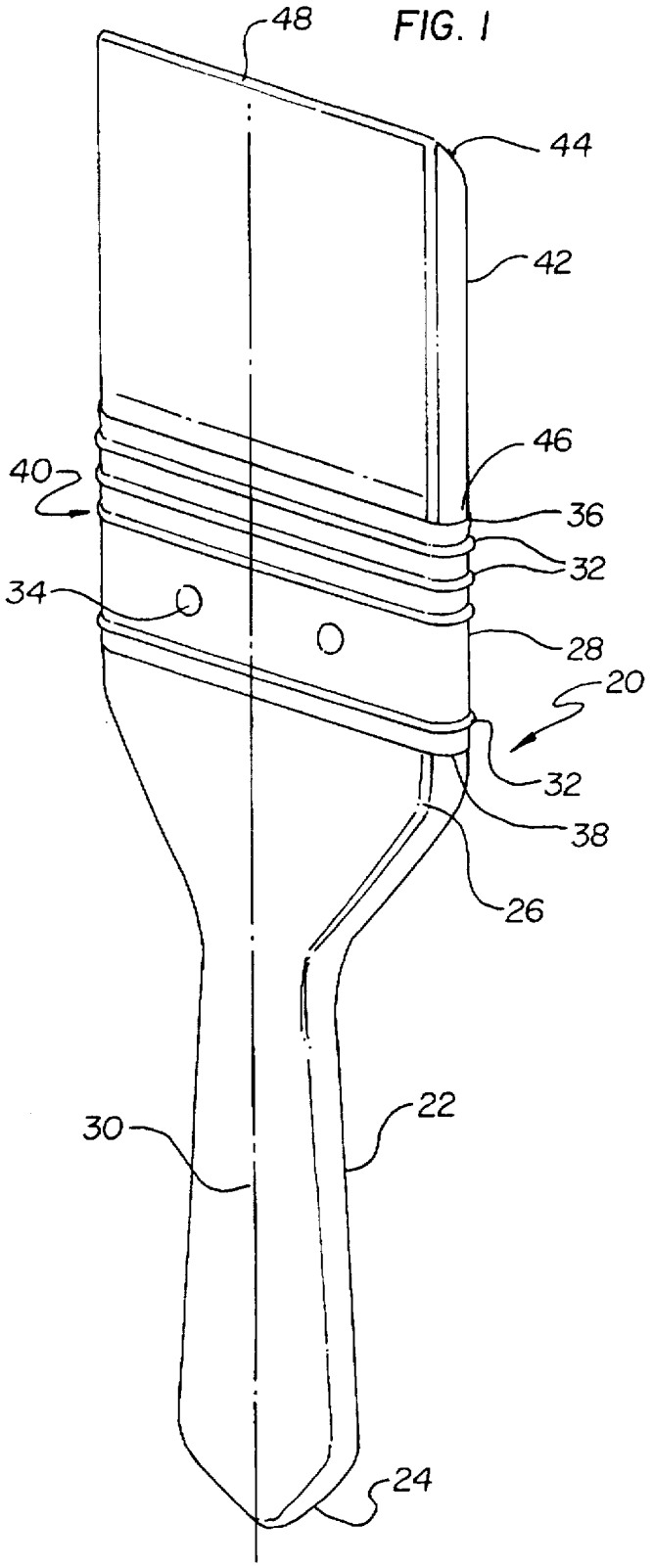
FIG. 1 is a perspective view of the paint applicator of the present invention.

As shown in FIG. 1, the device 20 has a handle 22 with a proximal end 24 and a distal end 26. As will be discussed later, the handle may be formed of wood, preferably varnished or lacquered hardwood, plastic or metal. Preferably, the handle 22 is similar to a conventional house paint brush handle having a wider distal end 26 than the proximal end 24, with distal end 26 having a generally rectangular cross-section taken perpendicular to the longitudinal axis 30 of handle 22.

Attached to the distal end 26 of the handle 22 is a ferrule 28. The ferrule 28 is rigid and in a preferred embodiment may be steel, stainless steel, brass, copper or aluminum or a "nickel" plated brass to prevent corrosion or other suitable metallic materials. Suitable ferrules could also be formed of plastic. Preferably, the ferrule 28 is attached to the distal end 26 of the handle 22 by crimping, as represented by one or more crimps 32 and by rivets 34. The ferrule 28 preferably is rectangular tubular shaped corresponding to the cross-section shape of and extending beyond the distal end 26 of the handle 22. Most preferably, the ferrule 28 is slightly tapered and is narrower in cross section at its distal end 36 than its proximal end 38. The extension of ferrule 28 at distal end 36 defines a cavity 40 as shown best in FIGS. 6–9. This cavity 40 lies adjacent to and extends longitudinally from the distal end 26 of the handle 22.

A resilient, flexible, non-porous working tip 42 is carried by cavity 40. Working tip 42 has a distal end 44 and a proximal end 46, the proximal end 46 being carried by cavity 40. Distal end 44 includes a distal working edge 48 being defined generally perpendicular to the longitudinal axis 30 of handle 22. Preferably, working tip 42 is generally rectangular in shape and has a longitudinal length of between 0.5" and 4.0", and a lateral width of between 0.25" and 4.0" and a thickness of between 0.1" and 1.0". Because working tip 42 has dimensional characteristics generally similar to those of conventional bristle brushes in that the maximum lateral width of working tip 42 is generally not greater than a maximum lateral cross-sectional width of distal end 26 of handle 22.

Figure 5:
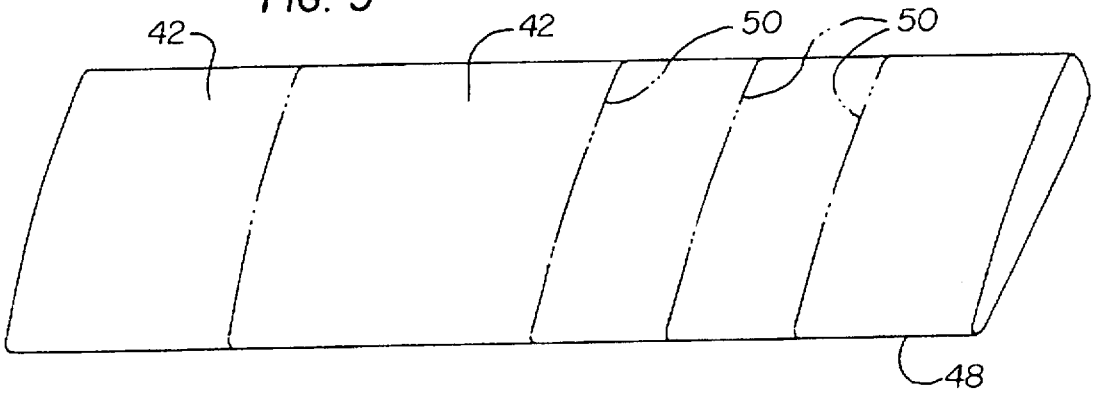
FIG. 5 is a perspective view of an extruded material from which working tips of the present invention are created.

Unlike prior silicone or rubber tips on paint applicators or removal tools which are individually cast, molded and/or cut pieces, the working tip 42 is an extruded material formed by an extrusion process in which the distal working edge 48 is extruded parallel to a longitudinal orientation of the extrusion process and then cut generally perpendicular to the longitudinal orientation, as shown for example in FIG. 5. The extrusion process reduces the overall cost of the present invention in two ways. First, the extruded material can be produced more economically, more quickly and more accurately than a corresponding cast material part. Second, the extruded material can be cut at multiple widths, as shown, for example, at 50, thereby allowing for the production of several different widths of working tips 42 out of the same extruded stock of material. The cut rubber tips could then be tumbled in an abrasive slurry to radius the edges, thus reducing possibility of disformation of the sharp cut edges by solvents or the like.

The working tip 42 is preferably formed of resilient silicone, although natural rubber, synthetic rubber, such as ethylene propylene or chloroprene rubber, PTFE, polyurethane, vinyl, soft plastics or any other impermeable, non-porous flexible rubber-like materials may be used as well. A notable quality of all the serviceable materials are the surface characteristics of the working tips 42. Preferably, dry or drying paint does not appear to stick to the surface which results in remarkably easy cleaning of the tool tips after use. The preferred silicone is characterized by low compression set (i.e. forming tips which do not substantially relax over time even under constant pressure, thus allowing maintenance of the locking relationship within the ferrule over time without the use of adhesives which might deteriorate in the presence of solvents); a high tear strength (Die B, ppi ASTM 624 method) of about 50–250 (i.e. forming tips which show little tendency to rip or tear when an artist is actively painting); hardness, after cure, of from about 20–70, and preferably from about 30 to 60, Shore A durometer hardness (ASTM 2240 method), with 25–40 Shore A durometer hardness used to form "softer" tips, 45–60 Shore A durometer hardness material used to form "firmer" tips and 60–770 Shore A durometer hardness material used to form "extra firm" tips. Most preferably, the catalyst use to cure the preferred silicone is platinum based (which provides greater solvent resistance). However, less expensive peroxide based catalyst systems are believed to be acceptable to form less demanding tips as might be appropriately supplied to children.

A preferred source of such material is Medical Grade Silastic ETR™ Elastomers Q7-4735 and Q7-4750 (an enhanced tear resistant silicone) available from Dow Corning, with Q7-4735 being used to form "softer" tips and Q7-4750 being used to form "firmer" tips. These products are supplied as two-part thermal-setting elastomers. A related product, Q7-4765 is arguably serviceable but results in too "firm" a tip for most painting purposes, however, this material works well for sculpture or pottery materials such as clays, waxes and plasters. These three products are also blendable to formulate intermediate hardnesses and Q7-4765 may be useful, for example, in such blends. Less costly commercial products having identical or nearly identical properties to Q7-4735, Q7-4750 and Q7-4765 are also available from the manufacturer, as "medical grade" nature of these particular materials is somewhat expensive due to the additional quality control required to meet medical standards. Examples of these less costly materials include HS-30, HS-50 and HS-70, all of which are commercial grade, platinum based, one-part silicones. The Q7-4535 and Q7-4750 products are represented by Dow Corning as consisting of dimethyl and methylvinyl siloxane copolymers and reinforcing silica. Other silicones which are serviceable in the production of tips, yet somewhat less desirable are: fluorosilicones (very solvent resistant but substantially more costly); general purpose silastics such as GP-50 and GP-30 from Dow Corning (sufficient strength but less solvent resistant which prevents extensive applications with oil based paints but does allow use with childrens' paints); RTV (room temperature vulcanization types) from Dow Corning; LSR (liquid silicone rubber) such as LSR 595-HC and LSR 590. Due to the vastly superior degree of control over the production process which is possible in an extrusion process, it is also possible, for example, to combine different compatible materials next to one another in a longitudinal side-by-side relationship, such that the proximal end 46 of working tip 42 would be made of a first stiffer material, an the distal end 44 would be made of a second, more flexible material. Alternative, it would be possible to continually vary the durometer of the material from the proximal end 46 to the distal end 44 of working tip 42.

Figure 2:
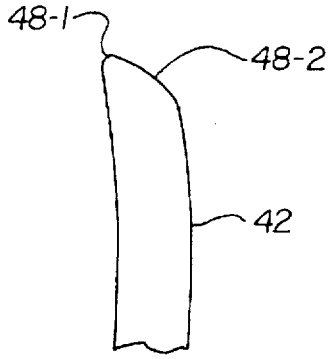
FIGS. 2–4 are cross-sectional views of various embodiments of the working tip of the present invention.
Figure 3:
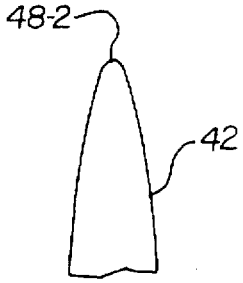
Figure 4:
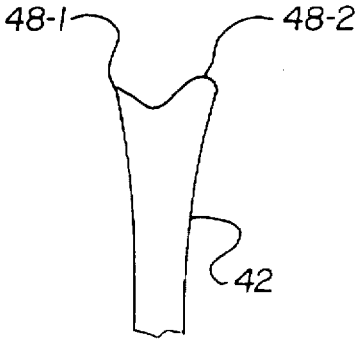

As shown in FIGS. 2–4, distal working edge 48 can be configured to assume various longitudinal cross-sectional shapes. Preferably, distal working edge 48 includes a pair of edges, a cutting edge 48-1 having a radius of between 0.005" and 0.0175", and preferably about 0.010", and a smoothing edge 48-2 having a radius greater than 0.0175", and preferably between 0.050" and 0.150". It has been found that materials with a radius of less than 0.005" have too sharp an edge (such as when a resilient material like silicone or rubber is cut), and that solvents and other chemicals, as well as the wear and tear of the painting action, will quickly destroy this kind of ultra-sharp edge. It will be seen that the working tip 42 can be provided with a single distal ridge incorporating both a cutting edge 48-1 and a smoothing edge 48-2, as shown in FIG. 2. Alternatively, a single edge, such as smoothing edge 48-2 can be provided as shown in FIG. 3. Still another embodiment utilize two or more separate distal ridges, one incorporating a cutting edge 48-1 and a second incorporating a smoothing edge 48-3 as shown in FIG. 4.

Referring again to FIG. 1, the preferred mechanism of attaching tip 42 to handle 22 is shown as utilizing ferrule 28 and rivets 34. Although ferrule 28 and rivets 34 are a preferred mechanism for attaching tip 42 to handle 22, it will be recognized that this attachment may be accomplished in other ways, such as by gluing or adhesively affixing the proximal end 46 of tip 42 to the distal end 26 of handle 22. FIGS. 6–13 depict some of the alternative ways of attaching tip 42 to handle 22 which are contemplated by the present invention. It will be understood that by the term attachment, the present invention contemplates both a relatively permanent fixation of tip 42 to handle 22, either directly or indirectly, as well as a selectively removable attachment of tip 42 to handle 22.

Figure 6:
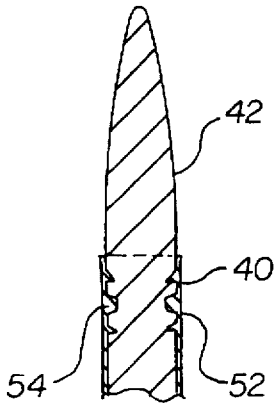
FIGS. 6–9 are cross-sectional views of various embodiments for attaching the working tip to the handle of the present invention.
Figure 7:
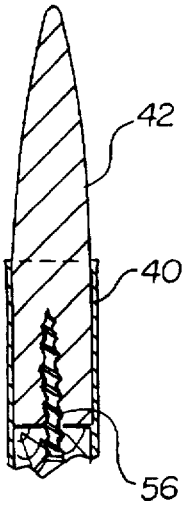
Figure 8:
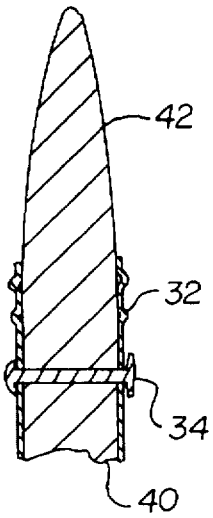

FIG. 6 shows the use of an adhesive 52 within ferrule 28, along with ridges 54 oriented in the direction of the extrusion process (and hence generally perpendicular to the longitudinal axis 30 of handle 22) in order to secure tip 42 within cavity 40. FIG. 7 shows the use of a tip expanding device 56, such as a screw or other similar insert for expanding the material of tip 42 outward to press on the inner walls of ferrule 28 within the confines of cavity 40. For a more detailed description of the various mechanisms which can accomplish this type of attachment, reference is made to U.S. Pat. No. 5,542,144, the disclosure of which is hereby incorporate by reference. FIG. 8 shows a cross-section of the preferred embodiment of the attachment of tip 42 to handle 22 by utilizing rivet 34. It will be noted that rivet 34 may extended through tip 42, handle 22, or a combination of tip 42 and handle 22, and may be used in connection with any number and location of crimps 32, depending upon how secure and expensive of an attachment is desired.

Alternatively, a male protrusion on the distal end 26 of handle 22 could be inserted into a corresponding female cavity within tip 42, or conversely a male protrusion on the proximal end of tip 42 could be inserted into a corresponding female cavity in the distal end 26 of handle 22. In either case, it would be possible to provide additional mechanical or chemical mechanisms, such as barbs, flanges, latches, screw threads, glue or adhesive, to assist in securing the tip 42 to the handle 22.

Figure 11:
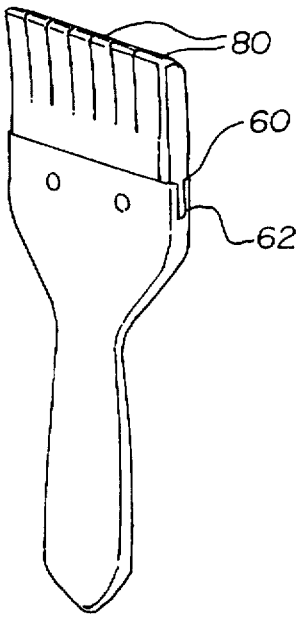

In an alternative embodiment of the present invention, as shown in FIGS. 9–13, a male rib 60 is provided in one of the handle 22 or tip 42 and a corresponding female channel or slot 62 is provided in the other of the handle 22 or tip 42. In the embodiments shown in FIGS. 9–11, the rib 60 and slot 62 are provided to improve the permanent attachment of tip 42 to handle 22. Numerous variations can be made to this embodiment, such as incorporating a ferrule 28 (FIGS. 9 and 10), or attaching tip 42 directly to handle 22 (FIG. 11). Rib 60 may be provided on handle 22 (FIG. 9) or may be provided on tip 42 (FIG. 11). Another alternative is to utilize a separate spacer 64 within ferrule 28 (FIG. 10) as a way to provide for increased stiffness within ferrule 28 and also cut down on the expense of the device by decreasing the amount of extrudable material required for working tip 42.

Figure 9:
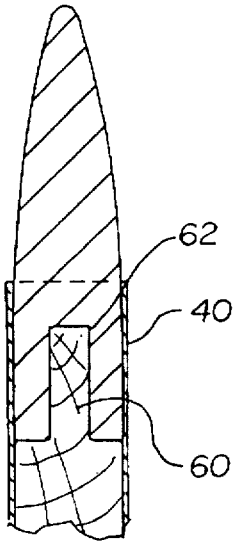
Figure 10:
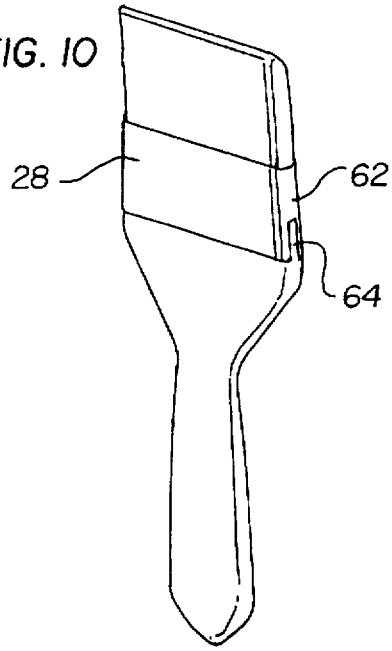
FIGS. 10 and 11 are perspective views of two variations of an alternate embodiment of the present invention.

A preferred manner of attachment is shown in FIG. 9 in which the working tip 42 with a slot 62 is stapled directly to the handle 22, after which the ferrule 28 is applied to the location where the handle 22 and the working tip 42 are joined and the entire combination is then affixed by stapling, riveting, gluing or crimping. Alternatively, the stapling of tip 42 to handle 22 could be omitted, in which case the rib 60 is used as a base for affixing the ferule 28 to both the handle 22 and the working tip 42.

Figure 12:
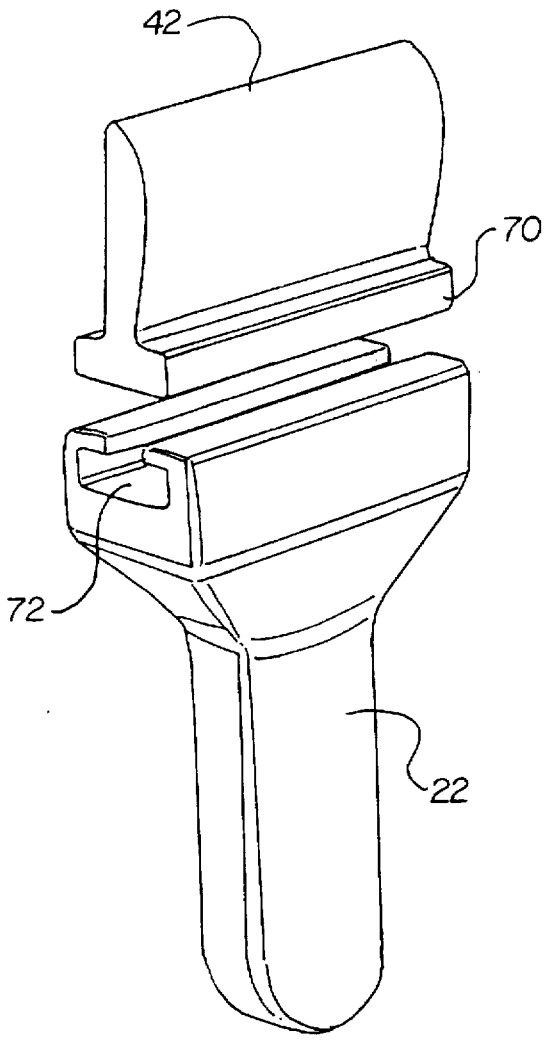
FIGS. 12 and 13 are perspective views of two variations of another alternate embodiment of the present invention.
Figure 13:
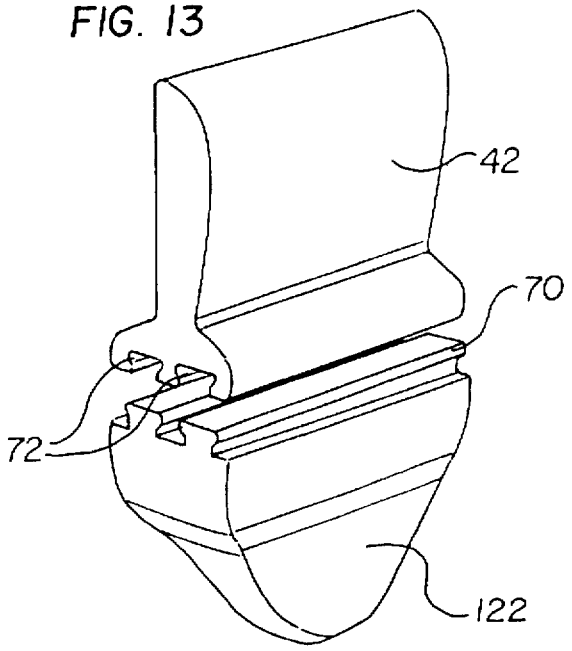

The present invention offers the possibility of interchangeably among a plurality of working tips 42 by providing an integral rib 70 or slot 72 within the distal end 46 of tip 42 and corresponding ribs 70 or slots 72 within a handle 22 as shown in FIGS. 12 and 13. In such an arrangement, a painter can be provided with a reduced quantity of handles and an array of tips 42. In this embodiment, the proximal end 46 of tip 42 has an increased thickness to accommodate either ribs 70 or slots 72 and to increase the dimensional stability of the proximal end 46 as it interfaces with the distal end 26 or handle 22. It will be seen that one or more ribs 70 and corresponding slots 72 may be provided and that tips 42 are slidably removed and inserted into handle 22 in a sliding orientation that is generally perpendicular to the longitudinal axis 30 of handle 22, thereby decreasing the possibility of tip 42 falling during application of paint to a substrate. It will also be noted that additional structure (not shown) may be provided to further secure tip 42 with handle 22, such as a clamping arrangement to exert lateral pressure against rib 70 and slot 72, or a locking mechanism on one or both ends of rib 70 and slot 72 to prevent accidental detachment of the two members during use of the device. Although a painter may readily recognize the various shapes available for employment, efficiency is enhanced by providing an inert distinct color indicia to signify the different hardnesses of the available tips. Such color indicia can be mixed with the tip material prior to molding to easily achieve this result.

Figure 14:
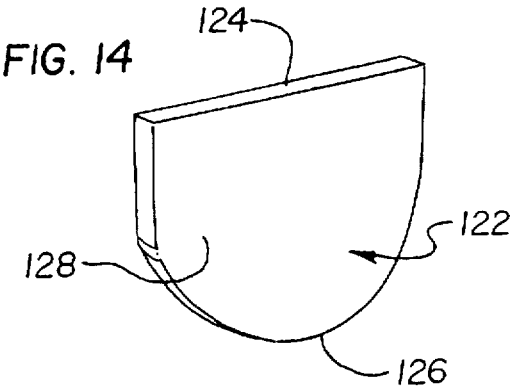
FIG. 14 is a plan view of an alternate embodiment of a handle of the present invention.

In a preferred embodiment of the alternative shown in FIGS. 13 and 14, a palm-conforming handle 122 is provided in place of the longer conventional handle 22. Palm-conforming handle 122 is designed to be completely held within the inner surface of the hand and preferably is a generally semi-circular shaped body 128 having a straight edge corresponding to distal end 124. In this embodiment, the "longitudinal" axis of handle 122 is oriented perpendicular to the straight edge corresponding to distal end 12 and the "longitudinal" length of handle 122 is less than 4.0". It should be noted that, while working tip 42 is generally flat or more rectangular in lateral cross section and straight in configuration due to its extruded nature, the body 128 of handle 122 could be ergonometrically designed to fit the interior palm of an individual at its proximal end 126, while retaining a generally straight edge corresponding to distal end 124 so as to receive working tip 42.

In an alternative embodiment shown in FIG. 11, a series of longitudinal slits 80 can be created in the distal end 44 of working tip 42 to enhance the wicking and paint carrying capability of the present invention. The depths of slits 80 can be cut entirely through tip 42, or only part way through tip 42. Similarly, the length of slits 80 can be any desired length relative to the length of tip 42. It is also possible to create a pair of complementary sets of slits, one on each side of tip 42 and leave a center, non-sliced portion therebetween. In addition to creating slits 80 by cutting or slicing tip 42, it is also possible to remove a portion of the material of tip 42 to create each slit 80. As shown in FIG. 11, slits 80 may be cut at differing depths across the lateral width of tip 42 to create a more flexible working tip (slits 80 at sides of tip 42 cut longer) or a stiffer working tip (slits 80 at center cut longer). The paint wicking and carrying capability is enhanced due to the mechanical nature of slits 80 and due to the increased surface area of tip 42 on which the paint can be carried. Slits 80 can also be used to create a different type of mark or stroke with the present invention.

In conclusion, it can be readily recognized that the present invention, in a number of embodiments provides a new tool for the application and manipulation of paint on a substrate, a method suitable for large scale economical production of a such a tool or for interchangeable tips from an array of tips.

Because numerous modifications may be made of this invention without departing from the spirit thereof, the scope of the invention is not to be limited to the single embodiment illustrated and described. Rather, the scope of the invention is to be determined by appended claims and their equivalents.

I claim:

1. A device for application and manipulation of paint on a substrate, comprising:

a handle having a distal end, a proximal end with a longitudinal axis defined therebetween, the distal end including structure defining a cavity therein; and a working tip inserted into the cavity and attached to the distal end of the handle, the working tip being a flexible, non-porous material having a distal working edge which is oriented generally perpendicular to the longitudinal axis and includes at least a first and a second peripheral edge curve formed thereon wherein the first curve is a peripheral cutting edge having a radius between 0.005 inches and 0.0175 inches and the second curve is a peripheral smoothing edge having a radius greater than 0.0175 inches.

2. The device of claim 1 wherein the working tip is a material selected from the set consisting of: silicone rubber, natural rubber, synthetic rubber, PTFE, polyurethane, vinyl, soft plastics, impermeable, non-porous flexible rubber-like materials, or any combination thereof.

3. The device of claim 1 wherein the working tip is an extruded material having characteristics selected from the set consisting of: a durometer hardness value of between 20 Shore A to 70 Shore A, a tear strength value of between 50 to 250 Die B, a low compression set, or any combination thereof.

4. The device of claim 1 wherein the working tip is generally rectangular in shape and has a longitudinal length, and a width and a thickness, and wherein the length is between 0.5 to 4.0 inches, the width is between 0.25 to 4.0 inches and the thickness is between 0.1 to 1.0 inches.

5. The device of claim 1 further comprising a ferrule wherein the distal end of the handle and a proximal end of the working tip are aligned coaxial within the ferrule without longitudinally overlapping and the ferrule is secured to the working tip, the handle or both by means selected from the set consisting of: stapling, nailing, crimping, gluing or expanding the tip outward against the ferrule.

6. The device of claim 1 wherein one of the working tip and the handle includes a rib along an end which interfaces the other and the other of the working tip and the handle includes a corresponding slot in an end which interfaces the one for mating with the rib.

7. The device of claim 1 wherein the working tip varies in durometer from a proximal end of the working tip to a distal edge of the working tip.

8. The device of claim 1 wherein the working tip includes at least one longitudinal slit defined in the distal working edge.

9. The device of claim 1 wherein the working tip includes an indicia color conveying visual information concerning a hardness of a material comprising the working tip.

10. A device for application and manipulation of paint on a substrate, comprising:

a handle having a distal end, a proximal end with a longitudinal axis defined therebetween, the distal end including structure defining a cavity therein; and a working tip inserted into the cavity and attached to the distal end of the handle, the working tip being a flexible, non-porous material which varies in durometer from a proximal end of the working tip to a distal end of the working tip.

11. The device of claim 10 wherein the working tip is a material selected from the set consisting of: silicone rubber, natural rubber, synthetic rubber, PTFE, polyurethane, vinyl, soft plastics, impermeable, non-porous flexible rubber-like materials, or any combination thereof.

12. The device of claim 10 wherein the working tip is an extruded material having characteristics selected from the set consisting of: a durometer hardness value of between 20 shore A to 70 Shore A, a tear strength value of between 50 to 250 Die B, a low compression set, or any combination thereof.

13. The device of claim 10 wherein the working tip includes a distal edge at the distal end of the working tip which is oriented generally perpendicular to the longitudinal axis and includes at least a first and second peripheral edge curve formed thereon wherein the first curve is, a peripheral cutting edge having a radius between 0.005 inches and 0.0175 inches and the second curve is a peripheral smoothing edge having a radius greater than 0.0175 inches.

14. The device of claim 10 wherein the working tip is generally rectangular in shape and has a longitudinal length, and a width and a thickness, and wherein the length is between 0.5 to 4.0 inches, the width is between 0.25 to 4.0 inches and the thickness is between 0.1 and 1.0 inches.

15. The device of claim 10 wherein the durometer of the working tip varies generally continuously from the proximal end to the distal end of the working tip.

16. The device of claim 10 wherein the durometer of the working tip includes at least a first durometer of the material at the proximal end and a second durometer of the material at the distal end.

* * * * *

UNITED STATES PATENT AND TRADEMARK OFFICE

CERTIFICATE OF CORRECTION

PATENT NO. : 5,749,117

DATED : May 12, 1998

INVENTOR(S) : Ladd B. Forsline

It is certified that error appears in the above-identified patent and that said Letters Patent is hereby corrected as shown below:

Column 2, lines 15 and 19, please capitalize the "S" in the word "shore".

Column 2, line 37, please change the word "utilizes" to the word "utilized".

Column 2, line 65, please change the word "Hardness" to the word "hardness".

Column 3, line 6, please delete the word "top" and replace with the word "tip".

Column 4, line 12, please change the word "DESCRIPTIONS" to the word "DESCRIPTION".

Column 4, line 49, please insert the word "as" between the words "of" and "a".

Column 5, line 36, please highlight in bold the numeral "50".

Column 5, line 65, please change the word "use" to the word "used".

UNITED STATES PATENT AND TRADEMARK OFFICE

CERTIFICATE OF CORRECTION

PATENT NO. : 5,749,117
DATED : May 12, 1998
INVENTOR(S) : Ladd B. Forsline

It is certified that error appears in the above-identified patent and that said Letters Patent is hereby corrected as shown below:

Column 6, line 32, please change the word "childrens'" to the word "children's".

Column 6, line 40, please delete the word "an" and replace with the word "and".

Column 6, line 61, please change the word "utilize" to the word "utilizes".

Column 7, line 23, please change the word "incorporate" to the word "incorporated".

Column 7, line 26, please change the word "extended" to the word "extend".

Column 7, line 62, please change the word "ferule" to the word "ferrule".

Column 7, line 65-66, please change the word "interchangeably" to the word "interchange".

UNITED STATES PATENT AND TRADEMARK OFFICE

CERTIFICATE OF CORRECTION

PATENT NO. : 5,749,117

DATED : May 12, 1998

INVENTOR(S) : Ladd B. Forsline

It is certified that error appears in the above-identified patent and that said Letters Patent is hereby corrected as shown below:

Column 8, line 67, please delete the word "a" at the beginning of the sentence.

Signed and Sealed this

Eighth Day of December, 1998

Bruce Lehman

*Attest:*

BRUCE LEHMAN

*Attesting Officer*

*Commissioner of Patents and Trademarks*